US010954683B2

(12) United States Patent
Adlivankin et al.

(10) Patent No.: US 10,954,683 B2
(45) Date of Patent: Mar. 23, 2021

(54) POOL CLEANER WITH STAIR IDENTIFICATION CAPABILITY

(71) Applicant: Aquatron Robotic Technology Ltd., Afula (IL)

(72) Inventors: Evgeny Adlivankin, Haifa (IL); Aharon Guetta, Afula (IL)

(73) Assignee: Aquatron Robotic Technology Ltd., Afula (IL)

( * ) Notice: Subject to any disclaimer, the term of this patent is extended or adjusted under 35 U.S.C. 154(b) by 176 days.

(21) Appl. No.: 16/400,040

(22) Filed: May 1, 2019

(65) Prior Publication Data

US 2019/0345728 A1 Nov. 14, 2019

(30) Foreign Application Priority Data

May 8, 2018 (IL) ..... 259196

(51) Int. Cl.

| | |
|---|---|
| ***E04H 4/16*** | (2006.01) |
| ***A47L 11/40*** | (2006.01) |
| ***A47L 9/28*** | (2006.01) |

(52) U.S. Cl.

CPC ..... *E04H 4/1654* (2013.01); *A47L 9/2805* (2013.01); *A47L 9/2852* (2013.01); *A47L 11/4011* (2013.01); *A47L 11/4061* (2013.01); *A47L 2201/04* (2013.01)

(58) Field of Classification Search

CPC ..... A47L 11/4011; A47L 11/4061; A47L 2201/04; A47L 9/2805; A47L 9/2852; E04H 4/1654

See application file for complete search history.

(56) References Cited

U.S. PATENT DOCUMENTS

| | | | | |
|---|---|---|---|---|
| 6,155,657 | A * | 12/2000 | Erlich | B62D 55/24 305/160 |
| 7,520,282 | B2 | 4/2009 | Stoltz | |
| 7,621,014 | B2 * | 11/2009 | Katz | E04H 4/1654 15/1.7 |
| 8,141,191 | B2 | 3/2012 | Hui | |

(Continued)

FOREIGN PATENT DOCUMENTS

| | | | | |
|---|---|---|---|---|
| EP | 3249137 | | 11/2017 | |
| EP | 3249137 | A1 * | 11/2017 | G05D 1/00 |
| EP | 3323963 | | 5/2018 | |

OTHER PUBLICATIONS

European Search Report for Application No. EP19173230.4, dated Oct. 11, 2019.

*Primary Examiner* — Marc Carlson

(74) *Attorney, Agent, or Firm* — Pearl Cohen Zedek Latzer Baratz LLP

(57) ABSTRACT

A pool cleaner for cleaning a pool includes a housing, a pump for drawing liquid from the pool into the housing through an inlet and expelling the liquid through an outlet when the pool cleaner is submerged in the pool, a filter for trapping debris that is in the indrawn liquid, and a propulsion system for propelling the pool cleaner along a submerged surface within the pool. A controller is configured to determine a position of the pool cleaner on a stairway of the pool, and to control the propulsion system to stop ascending the stairway when the pool cleaner is determined to have ascended to a highest permissible stair of the stairway.

20 Claims, 3 Drawing Sheets

(56) References Cited

U.S. PATENT DOCUMENTS

| | | | | |
|---|---|---|---|---|
| 8,397,330 | B2 * | 3/2013 | Pichon | E04H 4/1654 15/1.7 |
| 8,623,201 | B2 | 1/2014 | Hui | |
| 2007/0272273 | A1 | 11/2007 | Adam | |
| 2009/0057238 | A1 | 3/2009 | Garti | |
| 2011/0197932 | A1 * | 8/2011 | Mastio | E04H 4/1654 134/110 |
| 2012/0102664 | A1 * | 5/2012 | Hui | E04H 4/1654 15/1.7 |
| 2015/0322684 | A1 * | 11/2015 | Renaud | E04H 4/1654 15/1.7 |
| 2016/0060887 | A1 | 3/2016 | Tryber et al. | |
| 2017/0293490 | A1 | 10/2017 | Hanan et al. | |
| 2018/0148947 | A1 | 5/2018 | Durvasula et al. | |

* cited by examiner

POOL CLEANER WITH STAIR IDENTIFICATION CAPABILITY

CROSS-REFERENCE TO RELATED APPLICATIONS

This application claims priority benefit from Israeli Patent Application No. 259196, filed on May 8, 2018, which is hereby incorporated by reference in its entirety.

FIELD OF THE INVENTION

The present invention relates to pool cleaners. More particularly, the present invention relates to a pool cleaner with stair identification capability.

BACKGROUND OF THE INVENTION

Electrically powered or robotic pool cleaners may be configured to operate autonomously in a pool to move along the floor and walls of the pool while cleaning the liquid contents and interior surfaces of the pool. For example, such robotic pool cleaners may be configured to operate autonomously during hours in which the pool is not in use.

A typical robotic pool cleaner includes a housing or shell that encloses internal components of the pool cleaner. For example, a filtering system of the pool cleaner may include a filter or other device for cleaning water or other liquid that is drawn into the pool cleaner from the pool. A pump may provide suction for drawing water, which may include suspended debris, into the pool cleaner and to the filter. A drive mechanism may operate to propel the pool cleaner over the interior surfaces of the pool. A controller, typically programmable, may control operation of the drive mechanism and the pump. The controller typically includes one or more electronic circuits, including a micro-controller and power circuits for controlling the drive and pump motors according to a pre-programmed schedule. The controller may be programmed to operate the pool cleaner in accordance with inputs from various sensors.

SUMMARY OF THE INVENTION

There is thus provided, in accordance with an embodiment of the present invention, a pool cleaner for cleaning a pool, the pool cleaner including: a housing; a pump for drawing liquid from the pool into the housing through an inlet and expelling the liquid through an outlet when the pool cleaner is submerged in the pool; a filter for trapping debris that is in the indrawn liquid; a propulsion system for propelling the pool cleaner along a submerged surface within the pool; and a controller that is configured to determine a position of the pool cleaner on a stairway of the pool, and to control the propulsion system to stop ascending the stairway when the pool cleaner is determined to have ascended to a highest permissible stair of the stairway.

Furthermore, in accordance with an embodiment of the present invention, the pool cleaner includes a tilt sensor, wherein the controller is configured to detect ascending or descending a stair of the stairway in accordance with a sensed tilt of the pool cleaner.

Furthermore, in accordance with an embodiment of the present invention, the controller is configured to detect ascending the stair by detecting, when the pool cleaner is moving with a leading end facing a direction of motion of the pool cleaner, upward tilting of the leading end followed by leveling of the pool cleaner.

Furthermore, in accordance with an embodiment of the present invention, the controller is configured to detect descending the stair by detecting, when the pool cleaner is moving with a leading end facing a direction of motion of the pool cleaner, downward tilting of the leading end followed by leveling of the pool cleaner.

Furthermore, in accordance with an embodiment of the present invention, the controller is configured to increment a stair count when ascending the stair is detected, and to decrement the stair count when descending the stair is detected.

Furthermore, in accordance with an embodiment of the present invention, the controller is configured to compare the stair count with a stair count corresponding to the highest permissible stair.

Furthermore, in accordance with an embodiment of the present invention, the pool cleaner includes a depth sensor, wherein the controller is configured to detect ascending or descending a stair of the stairway in accordance with a depth of the pool cleaner below a waterline of the liquid in the pool.

Furthermore, in accordance with an embodiment of the present invention, the controller is configured to compare a sensed depth of the pool cleaner with a depth corresponding to the highest permissible stair.

Furthermore, in accordance with an embodiment of the present invention, the controller is configured to reverse a direction of motion of the pool cleaner when the pool cleaner is determined to have ascended to the highest permissible stair Furthermore, in accordance with an embodiment of the present invention, the controller is configured to reverse the direction of motion of the pool cleaner only if a cleaning program has not been completed.

Furthermore, in accordance with an embodiment of the present invention, completion of the cleaning program is indicated by elapse of a predetermined period of time from beginning of operation of the pool cleaner in the pool.

Furthermore, in accordance with an embodiment of the present invention, the controller is configured to stop operation of the pool cleaner when the pool cleaner is determined to have ascended to the highest permissible stair.

Furthermore, in accordance with an embodiment of the present invention, the controller is configured to stop the operation of the pool cleaner only if a cleaning program has been completed.

Furthermore, in accordance with an embodiment of the present invention, a position of the highest permissible stair is pre-programmed in the controller.

Furthermore, in accordance with an embodiment of the present invention, the controller is configured to enable entry of a position of the highest permissible stair via a communications link.

Furthermore, in accordance with an embodiment of the present invention, the highest permissible stair is selected such that when the pool cleaner is standing on the highest permissible stair, the outlet of the pool cleaner is at least a minimum depth below a level of the liquid in the pool.

Furthermore, in accordance with an embodiment of the present invention, the minimum depth is selected to prevent ejection of the liquid from the pool via the outlet.

There is further provided, in accordance with an embodiment of the present invention, a method for operation of a pool cleaner on a submerged stairway in a pool, the method including: operating a propulsion system of the pool cleaner to propel the pool cleaner along a submerged surface of the pool, the pool cleaner including a housing, a pump for drawing liquid from the pool into the housing through an inlet and expelling the liquid through an outlet when the pool cleaner is submerged in the pool, and a filter for trapping debris that is in the indrawn liquid; receiving by a controller from one or a plurality of sensors one or more measured values that are indicative of a position of the pool cleaner on the stairway; analyzing the one or more measured values by the controller to determine the position of the pool cleaner on the stairway; and controlling the propulsion system to stop ascending the stairway when the measured values indicate that the pool cleaner has ascended to a highest permissible stair of the stairway.

Furthermore, in accordance with an embodiment of the present invention, stopping the ascending includes reversing motion of the pool cleaner or stopping operation of the pool cleaner.

Furthermore, in accordance with an embodiment of the present invention, analyzing the one or more measured values includes, when the pool cleaner is moving with a leading end facing a direction of motion of the pool cleaner, determining that the pool cleaner has ascended a stair when the measured values from the tilt sensor indicate upward tilting of the leading end followed by leveling of the pool cleaner, and that the pool cleaner has descended a stair when the measured values from the tilt sensor indicate downward tilting of the leading end followed by leveling of the pool cleaner.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

DETAILED DESCRIPTION OF THE INVENTION

Figure 1A:
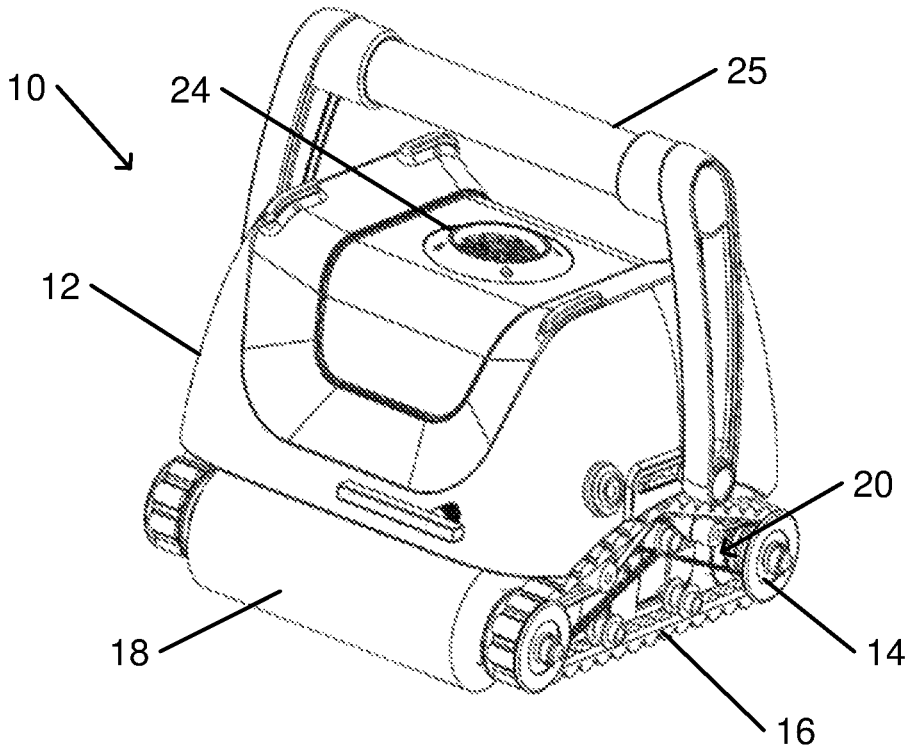
FIG. 1A schematically illustrates a robotic pool cleaner with stair detection capability, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Although embodiments of the invention are not limited in this regard, discussions utilizing terms such as, for example, "processing," "computing," "calculating," "determining," "establishing", "analyzing", "checking", or the like, may refer to operation(s) and/or process(es) of a computer, a computing platform, a computing system, or other electronic computing device, that manipulates and/or transforms data represented as physical (e.g., electronic) quantities within the computer's registers and/or memories into other data similarly represented as physical quantities within the computer's registers and/or memories or other information non-transitory storage medium (e.g., a memory) that may store instructions to perform operations and/or processes. Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method embodiments described herein are not constrained to a particular order or sequence. Additionally, some of the described method embodiments or elements thereof can occur or be performed simultaneously, at the same point in time, or concurrently. Unless otherwise indicated, the conjunction "or" as used herein is to be understood as inclusive (any or all of the stated options).

Some embodiments of the invention may include an article such as a computer or processor readable medium, or a computer or processor non-transitory storage medium, such as for example a memory, a disk drive, or a USB flash memory, encoding, including or storing instructions, e.g., computer-executable instructions, which when executed by a processor or controller, carry out methods disclosed herein.

In accordance with an embodiment of the present invention, a pool cleaner is configured to automatically operate on interior submerged surfaces of the pool, including stairs. The pool cleaner is configured to identify its position on the stairway as it ascends or descends stairs of the stairway. As used herein, a pool should be understood as including any type of swimming pool, tank, container, vat, bathtub, Jacuzzi, mikveh (ritual bath), or other walled structure that may be filled with water or another liquid, that may be provided with a stairway, and that is of suitable size and structure to enable cleaning by a pool cleaner as described herein. Similarly, reference herein to water or a waterline in the pool should be understood as referring to any liquid that fills the pool.

The pool cleaner may be provided with one or more sensors that are configured to detect movement of the pool cleaner that is indicative of ascending or descending a stair. For example, the sensors may include one or more tilt sensors, accelerometers, gyroscopes, or other types of sensors whose output signals may be analyzed to detect ascending or descending a stair.

A controller of the pool cleaner may be configured to count a number of stairs that are ascended or descended. For example, a memory of the controller may be utilized to record a current position of the pool cleaner within a flight of stairs, e.g., as a number of stairs above the floor of the pool.

An operator of the pool cleaner may indicate or program an uppermost stair of the flight to which the pool cleaner may climb. For example, the controller of the pool cleaner may communicate with one or more user-operable devices to enable an operator of the pool cleaner to input operating parameters. For example, an operator may input operating parameters via one or more fixed or portable computers or communication devices. Such devices may include a smartphone, a portable or fixed computer, a control panel on the pool cleaner (e.g., within a housing of the pool cleaner) or remote from the pool cleaner (e.g., on or near a power supply that provides power and enables data input to the pool cleaner via a cable), a remote control device, or another suitable device. The connection between the input device and the controller of the pool cleaner may be wired or wireless.

A propulsion mechanism of the pool cleaner may be configured to operate one or more wheels or tracks to propel the pool cleaner along a submerged surface of the pool. For example, the pool cleaner may include one or more motors, transmission systems, or other components that may be operated by a controller of the pool cleaner to rotate the wheels or tracks. In some cases, one or more other propulsion mechanisms may be provided (e.g., based on a propeller or other type of jet propulsion, or other mechanism). In such cases, the pool cleaner may include passive (e.g., not powered) wheels or tracks, e.g., to assist in steering or stabilizing the motion of the pool cleaner.

A suction mechanism (e.g., a powered pump) may be configured to draw liquid from the pool into an inlet of the pool cleaner. Typically, the inlet is located on or near a bottom surface of the pool cleaner that faces the surface of the pool along which the pool cleaner is being propelled. The indrawn liquid is expelled, after filtering or other treatment, through a liquid outlet of the pool cleaner. Typically, the liquid outlet is located on an upper surface of the pool cleaner, e.g., a surface that faces away from the surface along the pool cleaner is being propelled. Thus, when the pool cleaner is resting on or moving along a substantially horizontal surface, liquid is typically expelled upward toward the surface of the liquid in the pool.

For example, the pool cleaner may be configured such that the pool cleaner operates autonomously on a floor of the pool. In some cases, a leading end of the pool cleaner may contact a riser of a stair. As used herein, a leading end of the pool cleaner refers to a side, end, or edge of the pool cleaner that faces a direction in which the pool cleaner is currently moving, regardless of any structure or typical direction of movement of the pool cleaner. Similarly, a trailing end of the pool cleaner refers to a side, end or edge of the pool cleaner that faces substantially opposite of a direction in which the pool cleaner is currently moving, regardless of any structure or typical direction of movement of the pool cleaner. The propulsion system may be configured (e.g., friction between the riser and treads of the wheels or tracks may be sufficient) such that continued motion in the direction of the leading end causes the leading end to climb the riser to the tread at the top of the stair. During this time, a tilt sensor or other sensor may measure an upward tilt, an increase in tilt, or a rate of increase in tilt that is indicative of climbing the riser. A maximum tilt angle when ascending the stair may depend on the height of the riser (or rise), the width of the tread (also referred to as tread depth or going), as compared with a length (e.g., between a leading end and a trailing end) and location of a center of gravity of the pool cleaner, or on other dimensions or characteristics of the stair of pool cleaner. (In a typical pool stair, the tread ends at the riser and does not extend outward beyond the riser to form a nosing.)

Continued motion in the direction of the leading end may cause the pool cleaner to ascend to the tread of the stair. When ascending to the tread, the center of gravity of the pool cleaner may be moved to above the tread of the stair. At this point, gravity may cause the pool cleaner to begin tilting downward toward the horizontal. A tilt sensor or other sensor may then measure the decreased tilt angle, a decrease in tilt angle, a rate of decrease in tilt angle, or another indication of tilting toward the horizontal. The minimum tilt angle when ascending the stair may depend on the tread depth as compared with the length (or distance between the leading end and the center of gravity) of the pool cleaner. For example, if the tread depth is greater than (or approximately equal to) the length of the pool cleaner, the minimum tilt angle may approach zero (e.g., horizontal). In other cases, the minimum tilt angle may be less than zero.

When the pool cleaner is descending a stair, the leading end of the pool cleaner may extend outward beyond the end of the tread beyond the riser (between the tread of the upper stair being descended from and the tread of the lower stair being descended to). As the pool cleaner continues to move outward, gravity may cause the leading end of the pool cleaner to begin to tilt downward, which may be sensed by the sensors. As the pool cleaner continues to tilt downward, the leading edge or another part (typically of the bottom or treads) of the pool cleaner may contact the tread of the lower stair. Continued outward motion of the pool cleaner may reduce the downward tilt to a maximum (least downward) tilt.

A controller of the pool cleaner may be configured to receive and analyze signals from sensors of the pool cleaner. For example, the controller may be configured to analyze the signals to detect a current tilt of the pool cleaner. One or more other sensor or control signals may indicate a direction of motion of the pool cleaner. For example, detection of an upward tilt followed by reduction of the upward tilt to a minimum tilt angle may be interpreted as ascent of a single stair. Similarly, detection of a downward tilt followed by reducing the downward tilt to a maximum tilt angle (maximum upward tilt, corresponding to a minimum downward tilt) may be interpreted as descent of a single stair.

Alternatively or in addition, the controller may be configured to determine a position on a stairway by analyzing signals that are generated by one or more depth sensors. For example, a sensed change in depth below a waterline (e.g., distance from waterline or liquid pressure), may be interpreted as an indication of ascending or descending a stair, or as a change in position on the stairway. In some cases, the sensed change in depth may be interpreted as a change in position only if the sensed change in depth exceeds a threshold value. For example, the threshold value may be selected so as to reduce or eliminate misinterpretation of temporary or minor changes in depth that are due to waves on the liquid surface, displacement by objects that are introduced into or removed from the pool, or other circumstances (other than ascending or descending a stair) that may lead to a measured change in depth.

The controller may be configured to maintain in a memory a current location of the pool cleaner on the stairway, e.g., as represented by a numerical value. For example, the pool cleaner may be initially placed on the floor of the pool or on a specific stair. The initial position of the pool cleaner may be predetermined or entered, e.g., during installation of the pool cleaner or by an operator whenever the pool cleaner begins to operate in a particular pool. For example, the initial position may be assigned a value of zero when the pool cleaner begins operation on the floor of the pool, or may be assigned a positive integer value, e.g., that corresponds to a number of stairs above the floor of the pool from which the pool cleaner begins operation. Alternatively or in addition, other values may be used to indicate a position of the pool cleaner on the stairway (e.g., using negative integers, non-integer numbers, or otherwise). For example, another value may be indicative of a depth of the pool cleaner below the waterline of the pool.

Each time the pool cleaner ascends or descends a stair, e.g., as indicated by tilt measurements or otherwise (e.g., by depth sensors or otherwise), the value indicating the position of the pool cleaner may be updated. In the example above, the value may be increased by one when a stair is ascended, and decreased by one when a stair is descended. Alternatively or in addition, another method or value may be used to indicate a position of the pool cleaner on the stairway.

The controller of the pool cleaner may be preprogrammed to avoid climbing beyond a particular stair of the stairway, designated herein as the highest permissible stair. For example, a maximum stair number or stair count may be entered when the pool cleaner is initially configured for operation in a particular pool, when beginning a session of operation in the pool, may be preset at a factory (e.g., based on a typical pool), or at another time. As another example, during manual or direct operator control of operation of the pool cleaner, the pool cleaner may be caused to climb the stairway. The operator may then operate a control when the pool cleaner has ascended the highest permissible stair. The controller may then automatically store the number or other identification of the highest permissible stair. A highest permissible stair may be otherwise indicated (e.g., by a minimum distance to the waterline of the pool). For example, the highest permissible stair may be selected such that when the pool cleaner is operating on the stair, a depth below the waterline of the liquid outlet through which indrawn and filtered liquid is expelled into the pool is at least a minimum depth. The minimum depth may be selected such that the expelled liquid is not ejected above the waterline, is not sprayed to outside of the walls of the pool, or to otherwise prevent an undesirable discharge of the liquid.

In some cases, the controller pool cleaner may be configured to reverse the direction of motion after the pool cleaner has climbed to the highest permissible stair. Reversal of motion may involve interchanging the leading and trailing ends of the pool cleaner, or by physical turning of the pool cleaner (e.g., through 180°, or otherwise). Reversing the direction of motion may cause the pool cleaner to descend the stairway to the floor of the pool to continue operation in the pool. In some cases, the controller cleaner may be configured to stop motion or operation of the pool cleaner when the pool cleaner has ascended to the highest permissible stair. For example, the pool cleaner may stop at the highest permissible stair in order to facilitate removal of the pool cleaner from the pool. In some cases, the controller may be configured to reverse motion of the pool cleaner under some circumstances (e.g., when the pool cleaner has been operating for a time period that is less than a predetermined operating time such as a time of operation that is deemed sufficient to adequately clean the pool, prior to a particular time of day such as a time when the pool is opened for use, or another predetermined condition), and to stop movement or operation under another circumstance (e.g., after a minimum period of operation, after a particular hour of the day, or under another predetermined condition).

A pool cleaner with stair detection capability may be advantageous over pool cleaners that lack this capability. For example, a pool cleaner that lacks stair detection capability could, in some cases, climb a stairway until the liquid outlet is above the water level of the pool. In some such cases, the suction could be reduced until there is inadequate traction to enable further propulsion of the pool cleaner (e.g., could not travel back down the stairway). In some cases where the pool cleaner lacks stair identification capability and when there is insufficient depth between the top or liquid outlet of the pool cleaner below the waterline, liquid could be ejected by the pool cleaner to the surfaces that adjoin the pool. Such ejection of liquid could be problematic for several reasons. For example, emptying the pool of its liquid contents may be problematic where water (or another liquid that fills the pool) is scarce. Liquid that is ejected to the sides of the pool and then flows back into the pool could bring additional dirt or debris into the pool. Wetting the surfaces that adjoin the pool could make these surfaces slippery and unsafe for walking. In the case of a mikveh, excessive ejection of water (and reduction of the volume of contained water below a minimum required volume, e.g., that enables complete immersion of a typical adult human body) could render the mikveh unsuitable for its intended (e.g., ritual) purposes.

A pool cleaner with stair identification capability, on the other hand, may be programmed or otherwise configured to avoid ascending to a stair where traction is reduced or where liquid is ejected from the pool.

Figure 1B:
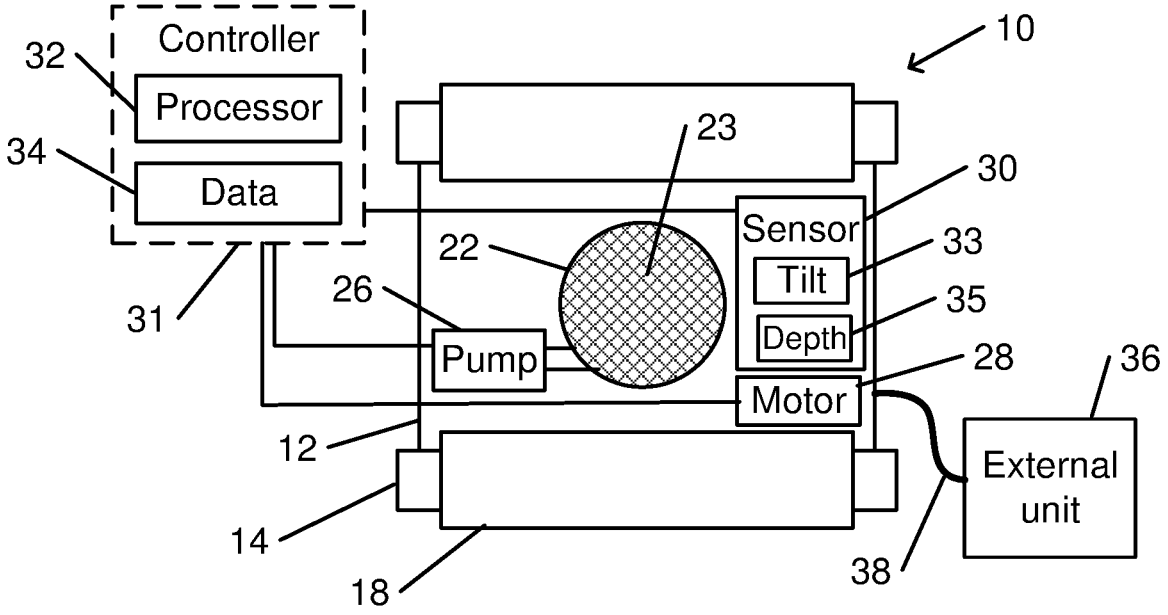
FIG. 1B schematically illustrates a bottom side of the robotic pool cleaner shown in FIG. 1A.

FIG. 1A schematically illustrates a robotic pool cleaner with stair detection capability, in accordance with an embodiment of the present invention. FIG. 1B schematically illustrates a bottom side of the robotic pool cleaner shown in FIG. 1A.

Robotic pool cleaner 10 is configured to autonomously clean a liquid-filled pool that includes a stairway, such as a water-filled swimming pool or other type of pool. Cleaner housing 12 of robotic pool cleaner 10 may house internal components of robotic pool cleaner 10, and may serve as a surface to which exterior components of robotic pool cleaner 10 are mounted. Cleaner housing 12 may include one or more interior partitions or chambers, e.g., for enclosing components that are isolated from the liquid, for collecting debris that is trapped by a filter, for guiding a flow of liquid through cleaner housing 12, or for other purposes.

A locomotion system of robotic pool cleaner 10 may include one or more motors 28. Motor 28 may be housed inside cleaner housing 12 and may drive locomotion wheels 14 via transmission 20. Transmission 20 may include one or more shafts, gears, belts, pulleys, levers, or other transmission components. Locomotion wheels 14 may be provided with tracks 16, or other traction-increasing surfaces or components (e.g., tires, suction cups, rubber or adhesive surfaces, or other types of components or surfaces). In some cases, transmission 20 may be controlled so as to rotate locomotion wheels 14 on different sides of robotic pool cleaner 10 at different rates, e.g., so as to turn robotic pool cleaner 10. In some cases, different locomotion wheels 14 of robotic pool cleaner 10 (e.g., on different sides of robotic pool cleaner 10) may be operated by different, separately controllable, motors 28. In some cases, motor 28 may propel robotic pool cleaner 10 by rotating a propeller, operating a fin or paddle, by ejecting the indrawn liquid toward the direction opposite of that of the motion, or by otherwise creating a fluid jet for propelling robotic pool cleaner 10.

In some cases, a cleaning brush 18 may rotate together with, or separately from (e.g., by a mechanism that is separate from the mechanism for driving), locomotion wheels 14. Cleaning brush 18 may loosen dirt or debris that adheres to the pool surface, to enable the dirt and debris to be lifted into robotic pool cleaner 10 by a suction system of robotic pool cleaner 10.

A suction system of robotic pool cleaner 10 may include a suction pump 26. For example, suction pump 26 may employ a rotating screw, impeller, propeller, centrifugal impeller, or other mechanism to draw liquid from the pool into intake port 22 on the bottom surface of robotic pool cleaner 10. As used herein, the bottom or bottom surface of robotic pool cleaner 10 refers to the side or surface of robotic pool cleaner 10 or of cleaner housing 12 that faces a pool surface that is being cleaned or over which robotic pool cleaner 10 is being propelled. The liquid that enters intake port 22 may pass through filter 23 or another type of trapping that is configured to trap dirt or debris that is suspended in the liquid that flows into intake port 22. The filtered liquid may then be expelled via outflow port 24. For example, outflow port 24 may be located on a top or upper surface of robotic pool cleaner 10. In some cases, e.g., when outflow from outflow port 24 is utilized for propulsion of robotic pool cleaner 10, outflow port 24 may be located on a front or rear side of robotic pool cleaner 10.

Electrical power for operating one or both of motor 28 and suction pump 26, may be provided by an internal power source (e.g., by a storage battery or other internal or onboard source) that is housed in cleaner housing 12. Alternatively or in addition, electrical power may be provided by a power source that is located in external unit 36 that is connected to robotic pool cleaner 10 by cable 38. For example, external unit 36 may be located outside of the pool or may be configured to float on the water surface. Typically, electrical power that is provided to robotic pool cleaner 10 is in the form of low voltage direct current power (e.g., having a voltage similar to that of a typical storage battery or other battery).

In some cases, external unit 36 may include a control panel or other controls to enable direct or manual user operation of robotic pool cleaner 10. In some cases, external unit 36 may be configured to enable an operator of robotic pool cleaner 10 to input parameters (e.g., indicating a highest permissible stair or another parameter for utilization in operating robotic pool cleaner 10).

In some cases, a single motor 28 may drive both suction pump 26 and locomotion wheels 14. For example, motor 28 may be linked to locomotion wheels 14 and to suction pump 26 by different transmissions. In some cases, the different transmissions may be operated independently of one another such that operation of locomotion wheels 14 may be independent of operation of suction pump 26. In some cases, operation of locomotion wheels 14 and of suction pump 26 may be linked. In some cases, suction pump 26 may be driven by a motor that is separate from motor 28.

Operation of motor 28 and suction pump 26 may be controlled by controller 31. Controller 31 may include one or more components. Some or all components of controller 31 may be located on robotic pool cleaner 10. Alternatively or in addition, some or all components of controller 31 of robotic pool cleaner 10 may be located in external unit 36 or on another external device that is in wired or wireless communication with robotic pool cleaner 10 or with external unit 36. When external to robotic pool cleaner 10, controller 31 may communicate with components of robotic pool cleaner 10 via cable 38 or wirelessly.

For example, controller 31 may include a processor 32. Processor 32 may include one or more processing units (e.g., computers or micro-controllers) that are configured to operate in accordance with programmed instructions.

Data storage 34 may include one or more fixed or removable, volatile or nonvolatile, memory or data storage units. Data storage 34 may be utilized, for example, to store programmed instructions for operation of processor 32, data or parameters for utilization by processor 32 (e.g., as entered by an operator of robotic pool cleaner 10, as obtained by sensors 30, or as obtained from another source, such as a navigation or external system with which controller 31 is in communication), or results of a calculation or operation of processor 32. For example, data storage 34 may be utilized to store an identification of a current position (e.g., stair count or other indication or identification) on a stairway, identification of a highest permissible stair (e.g., stair count, depth below a waterline, or other indication or identification), or other parameters.

Controller 31 may receive sensed data from sensors 30. Sensors 30 may include one or more sensors that are located on robotic pool cleaner 10, or external to robotic pool cleaner 10. Sensors 30 may include one or more sensors that enable monitoring movement of robotic pool cleaner 10. For example, sensors 30 may include an encoder or rotation sensor that measures a rotation angle or a rotation rate of one or more rotatable components of motor 28, transmission 20, or of locomotion wheels 14, e.g., to indicate a direction of motion of robotic pool cleaner 10. Sensors 30 may include one or more tilt sensors 33 that are configured to measure a tilt, or a rate of change of tilt, of robotic pool cleaner 10. For example, tilt sensors 33 may include one or more automatic levels, electronic tilt sensors, accelerometers (e.g., solid state accelerometer), gyroscopes, rolling-ball switches, optical sensors, or other sensors configured to sense a tilt or change in tilt of robotic pool cleaner 10 (e.g., at least a pitch along a forward-backward direction). Sensors 30 may include one or more proximity sensors or rangefinders that enable sensing of a distance from a surface, such as a pool surface or waterline. Such distance sensors may be based on optical, acoustic, electromagnetic, mechanical, or other appropriate mechanisms. Sensors 30 may include a depth sensor (e.g., acoustic, optical, or other distance sensor), pressure sensor, or other sensor for measuring a depth of robotic pool cleaner 10 below a waterline of a liquid in the pool. Sensors 30 may include a flow sensor for measuring a flow rate of liquid, e.g., in the suction system or relative the water in the pool. Sensors 30 may include a force or torque sensor to measure a force or torque that is exerted on locomotion wheels 14. In some cases, some or all of sensors 30 may be incorporated into a single integrated unit.

Controller 31 may be configured to control and monitor operation of one or both of motor 28 and suction pump 26.

Figure 2:
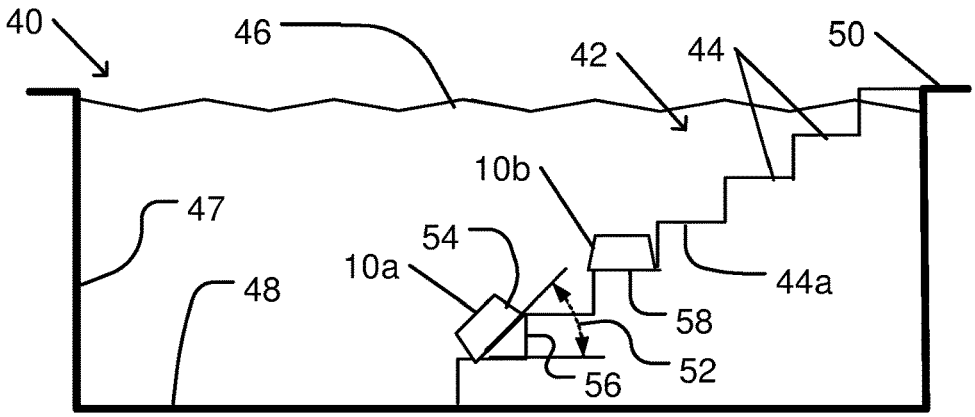
FIG. 2 schematically illustrates climbing a stairway by the pool cleaner shown in FIG. 1A.

FIG. 2 schematically illustrates climbing a stairway by the pool cleaner shown in FIG. 1A.

In the example shown, pool 40 includes a stairway 42 with a plurality of stairs 44. In the example shown, stairway 42 extends from pool floor 48 to the level of poolside surface 50. In other examples, stairway 42 may extend only partly up the side of pool 40. Pool 40 may be filled with a liquid to a level indicated by waterline 46, typically lower than poolside surface 50. Thus, at least some stairs 44 of stairway 42 may be submerged below waterline 46. Pool 40 is enclosed by walls 47.

One of stairs 44 is designated highest permissible stair 44*a*. For example, highest permissible stair 44*a* may be selected such that, when a robotic pool cleaner 10 is standing on highest permissible stair 44*a*, a distance between a top surface of that robotic pool cleaner 10 and waterline 46 exceeds a minimum allowed distance (e.g., to enable effective locomotion of robotic pool cleaner 10, to prevent removal of liquid from pool 40, to prevent wetting of poolside surface 50, or otherwise determined). In some cases, highest permissible stair 44*a* may have a default that may be selected as suitable for most pools 40 (e.g., the third stair 44 above pool floor 48, or another selected stair 44).

Highest permissible stair 44*a* may be pre-programmed in the controller memory as a fixed instruction or may be selected by an operator of robotic pool cleaner 10 via a user interface and communications link. The user interface may include a panel on cleaner housing 12, on external unit 36, or elsewhere. Alternatively or in addition, a wireless link to an external device (e.g., a smartphone or portable computer)

may be employed. Alternatively or in addition, highest permissible stair 44*a* may be selected by manually commanding pool cleaner 10 to reverse direction upon ascending a stair 44 that the operator wishes to designate as highest permissible stair 44*a*.

In the example shown, robotic pool cleaner 10*a* is moving in a general direction toward the upper end of stairway 42. Leading end 54 of robotic pool cleaner 10*a* has contacted and moved to the top of stair riser 56. As leading end 54 climbs stair riser 56, tilt angle 52 of robotic pool cleaner 10*a* increases. The increase in tilt angle 52 may be detected by one or more sensors 30 of robotic pool cleaner 10*a*.

Continued forward motion of robotic pool cleaner 10*a* may propel leading edge over stair riser 56. After tilt angle 52 reaches a maximum (e.g., that depends on dimensions of robotic pool cleaner 10 and of stairs 44), tilt angle 52 may begin to decrease. For example, after the center of gravity of a robotic pool cleaner 10 crosses the top of stair riser 56, gravity may act on that robotic pool cleaner 10 to reduce its tilt angle 52 until that robotic pool cleaner 10 is oriented horizontally (or at a minimum positive tilt angle 52) on a tread of the next higher stair 44. The decrease in tilt angle 52 may be detected by one or more sensors 30.

In the example shown, robotic pool cleaner 10*b* is oriented horizontally on stair tread 58. Continued forward motion of robotic pool cleaner 10*b* may cause robotic pool cleaner 10*b* to continue to ascend to the next higher stair 44 (which is highest permissible stair 44*a* in the example shown).

Controller 31 may be configured to operate robotic pool cleaner 10 on a stairway 42 in accordance with a predetermined method.

Figure 3:
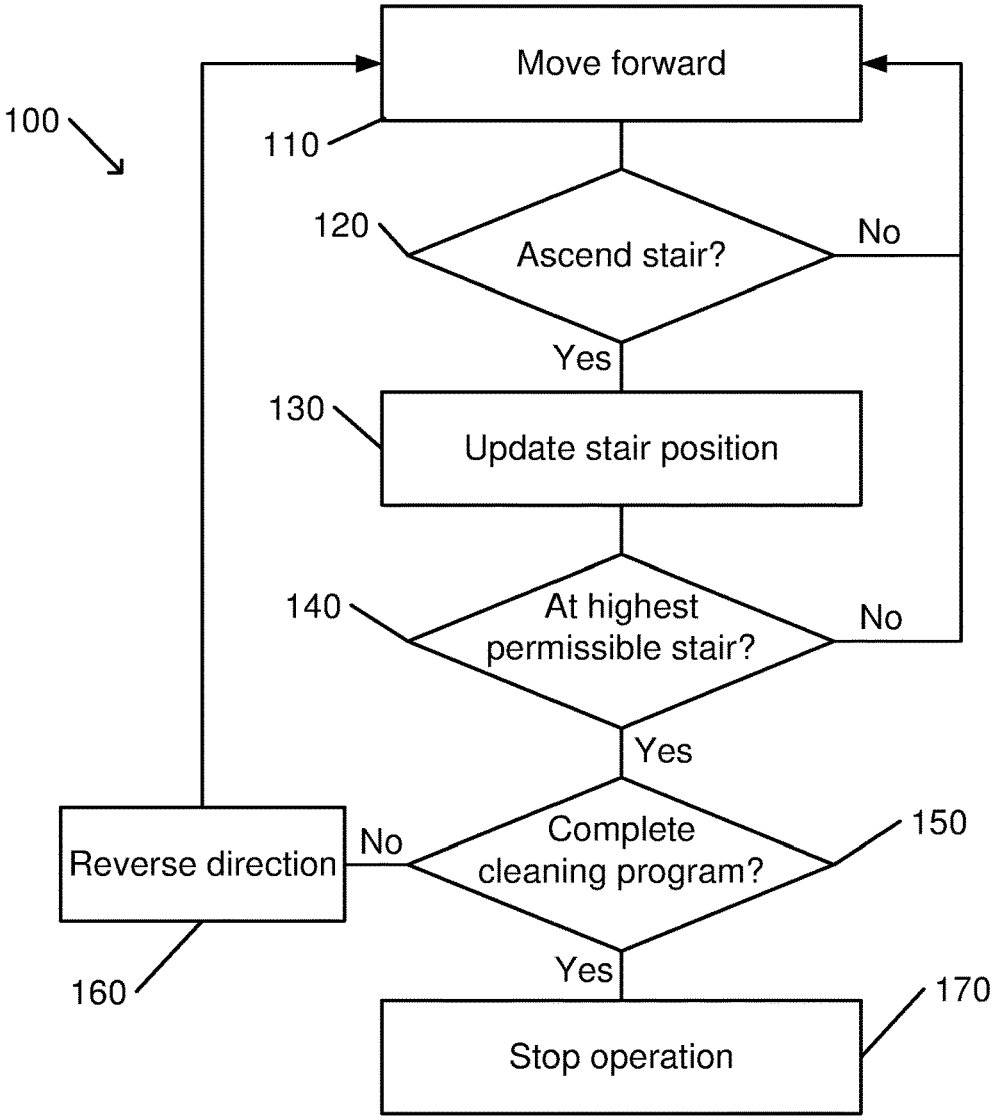
FIG. 3 is a flowchart depicting a method of operation of a pool cleaner on a stairway.

FIG. 3 is a flowchart depicting a method of operation of a pool cleaner on a stairway.

It should be understood with respect to any flowchart referenced herein that the division of the illustrated method into discrete operations represented by blocks of the flowchart has been selected for convenience and clarity only. Alternative division of the illustrated method into discrete operations is possible with equivalent results. Such alternative division of the illustrated method into discrete operations should be understood as representing other embodiments of the illustrated method.

Similarly, it should be understood that, unless indicated otherwise, the illustrated order of execution of the operations represented by blocks of any flowchart referenced herein has been selected for convenience and clarity only. Operations of the illustrated method may be executed in an alternative order, or concurrently, with equivalent results. Such reordering of operations of the illustrated method should be understood as representing other embodiments of the illustrated method.

Stairway navigation method 100 may be executed by a processor 32 of a controller 31 of a robotic pool cleaner 10.

Stairway navigation method 100 may be executed when robotic pool cleaner 10 is moving in a forward direction (block 110). A typical robotic pool cleaner 10 may be capable of locomotion in two opposite directions, e.g., by reversing a direction of rotation or torque of motor 28. The direction toward which robotic pool cleaner 10 is moving during of execution of stairway navigation method 100 is considered to be the forward direction. For example, the direction of forward motion may reverse or change after robotic pool cleaner 10 encounters a wall 47 of pool 40.

During forward locomotion of robotic pool cleaner 10, tilt of robotic pool cleaner 10 may be monitored via one or more tilt sensors 33. Alternatively or in addition, a depth of robotic pool cleaner 10 below waterline 46 may be measured by one or more depths sensors 35.

Data from sensors 30 may be interpreted by processor 32 as indicative of ascending or climbing a stair 44 (block 120). For example, data from a tilt sensor 33 may be utilized using stair detection method 200 (see FIG. 4), may be applied. Alternatively or in addition, a decrease in depth, e.g., as measured by a depth sensor 35, may be indicative of ascending a stair 44. If no ascending of a stair 44 is indicated, forward motion of robotic pool cleaner 10 may continue (returning to block 110).

If a stair 44 was ascended, a position of robotic pool cleaner 10 on stairway 42 may be updated (block 130). For example, a stair count in the form of an integer that is indicative of a number of a stair 44 above pool floor 48 on which robotic pool cleaner 10 is currently located (e.g., resting horizontally or at a minimum tilt angle 52) may be incremented by one. A value that is stored in data storage 34 that is otherwise indicative of a current stair 44 of stairway 42 (e.g., a depth below waterline 46 or other value) may be otherwise updated to indicate the current stair 44.

The updated position on stairway 42 may be compared with the position of highest permissible stair 44*a* (block 140). For example, a current stair count or depth may be compared with that of highest permissible stair 44*a*. If the current position is below that of highest permissible stair 44*a*, forward motion (block 110) may continue.

If the updated position indicates that robotic pool cleaner 10 is currently on highest permissible stair 44*a*, further action may depend on whether or not a predetermined cleaning program is completed (block 150) or on one or more alternative or additional circumstances. For example, a cleaning program may be considered to be completed when robotic pool cleaner 10 has operated in pool 40 for a minimum period of time. Other conditions indicating an end of a cleaning program may include sensing that a compartment or container for collecting debris that is filtered from the inflowing liquid has been filled, sensing that an internal power supply (e.g., storage battery charge or fuel tank) is close to depletion, that a minimum area of pool 40 or of pool floor 48 has been covered (e.g., when robotic pool cleaner 10 is provided with a navigation system), or other circumstances.

If the cleaning program has not completed, or if robotic pool cleaner 10 is otherwise to continue operating in pool 40, a direction of motion of robotic pool cleaner 10 may be reversed (block 160). For example, a direction of rotation of motor 28 may be reversed, a transmission 20 may be modified, robotic pool cleaner 10 may be turned, or the direction of motion of robotic pool cleaner 10 may be otherwise reversed. Robotic pool cleaner 10 may continue to operate in the new forward direction (block 110).

During continued operation of robotic pool cleaner 10, robotic pool cleaner 10 may descend a stair 44. When a stair is descended, the current stair position may be updated (e.g., a stair count may be decremented by one), e.g., until the current stair position is indicated to be pool floor 48 (e.g., stair number 0, depth greater than depth of lowest stair 44, or otherwise indicated).

If the cleaning program is complete when robotic pool cleaner 10 is indicated to be on highest permissible stair 44*a*, operation of one or more of motor 28, pump 26, other components of robotic pool cleaner 10 may be halted (e.g., electrical power supply to those components may be cut off).

For example, robotic pool cleaner 10 may remain on highest permissible stair 44*a* until removed by an operator, or until reactivated by the operator.

In some cases, action by robotic pool cleaner 10 after ascending to highest permissible stair 44*a* may be determined in accordance with one or more other criteria. For example, a robotic pool cleaner 10 may be configured to always reverse direction or to always stop operation upon reaching highest permissible stair 44*a*. A robotic pool cleaner 10 may be configured to perform one or more other actions (e.g., generate an alarm signal, or other actions) upon ascending highest permissible stair 44*a*.

Figure 4:
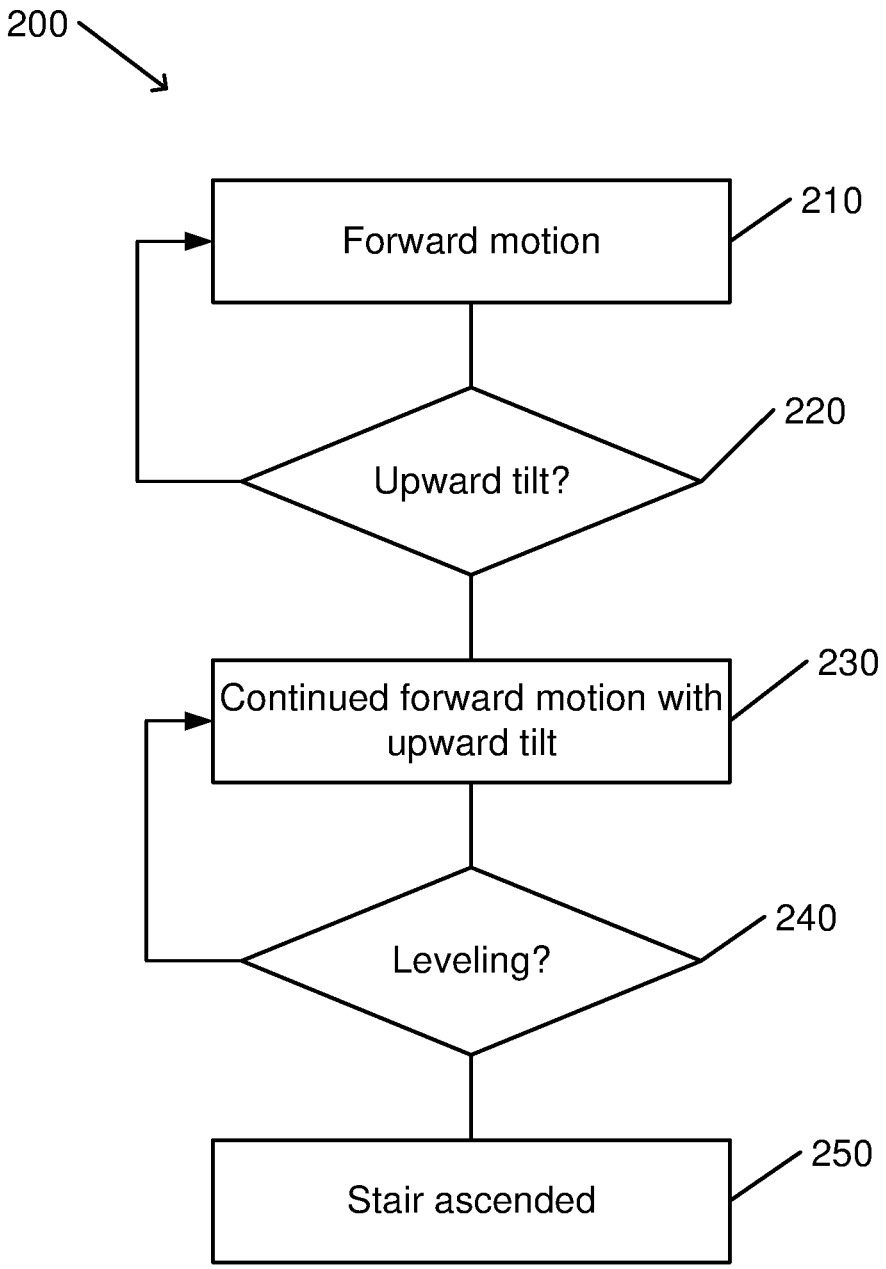
FIG. 4 is a flowchart depicting a method of detection of ascending a stair by a pool cleaner using a tilt sensor.

FIG. 4 is a flowchart depicting a method of detection of ascending a stair by a pool cleaner using a tilt sensor.

Stair ascent detection method 200 may be executed by a processor 32 of a controller 31 of robotic pool cleaner 10.

Stair ascent detection method 200 may be executed when robotic pool cleaner 10 is moving in a forward direction with a leading end facing the direction of motion (block 210).

Processor 32 may receive a signal from one or more sensors 30 of robotic pool cleaner 10 that indicate an upward tilt of the leading end of robotic pool cleaner 10 (block 220). For example, a direction of rotation of motor 28 or wheels 14 may be monitored or sensed to identify leading end 54 of robotic pool cleaner 10. A tilt sensor 33 of sensors 30 may sense a tilt, e.g., as a tilt angle 52 (or value indicative of tilt angle 52), of robotic pool cleaner 10. An upward tilt of robotic pool cleaner 10 may be indicated if the sensed tilt indicates that leading end 54 is tilted upward (e.g., above a trailing end of robotic pool cleaner 10). In some cases, the upward tilt may be indicated only if the measured upward tilt angle 52 is greater than a threshold tilt angle. The threshold value tilt angle may be determined in accordance with dimensions of robotic pool cleaner 10 and of stair 44 (e.g., by a length of robotic pool cleaner 10 and a rise or height of riser 56, or otherwise). The detected upward tilt may be indicative of reaching or climbing a stair 44 of stairway 42 or a wall 47 of pool 47.

If no upward tilt is measured, forward motion continues (block 210).

If an upward tilt is detected, forward motion continues with an upward tilt (block 230). For example, during the continued forward motion, the upward tilt angle 52 may be maintained or may continue to increase.

During the continued forward motion with upward tilt, leveling of robotic pool cleaner 10 may be detected (block 240). For example, a tilt sensor 33 may detect a decrease in an upward tilt angle 52 (e.g., lowering of leading end 54 relative to a trailing end of robotic pool cleaner 10). In some cases, a decrease in tilt angle 52 may not be considered as leveling unless tilt angle 52 is decreased to below a threshold tilt angle. For example, a threshold tilt angle to indicate leveling may be determined in accordance with dimensions of robotic pool cleaner 10 and of stair 44 (e.g., by a length of robotic pool cleaner 10 and a tread depth of tread 58, or otherwise).

The leveling of robotic pool cleaner 10 may be indicative of having ascended a stair 44 (block 250). For example, the leveling of robotic pool cleaner 10 may indicate that a center of gravity of robotic pool cleaner 10 has moved to above tread 58 of the ascended stair 44. Processor 32 may then update a stored indication of a location of robotic pool cleaner 10 on stairway 42.

Continued forward motion with upward tilt without leveling may be indicative of climbing a wall 47 or otherwise moving along an upward slope within pool 40. Threshold angle values for indicating an upward tilt and leveling may be selected so as to prevent misidentification of climbing of a sloped surface on floor 48 of pool 40 (e.g., a sloped surface at a transition between a deep end and shallow end of a pool 40) as climbing a stair.

It may be noted that a method for detection of descending a stair 44 may be similar to stair ascent detection method 200. However, in such a stair descent detection method, a downward tilt of leading end 54 may be initially detected (e.g., opposite of the operation of block 220). Descent of the stair may then be indicated when forward motion with a downward tilt is terminated by leveling (e.g., with decreasing downward tilt angle).

Different embodiments are disclosed herein. Features of certain embodiments may be combined with features of other embodiments; thus, certain embodiments may be combinations of features of multiple embodiments. The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A pool cleaner for cleaning a pool, the pool cleaner comprising:

a housing;

a pump for drawing liquid from the pool into the housing through an inlet and expelling the liquid through an outlet when the pool cleaner is submerged in the pool;

a filter for trapping debris that is in the indrawn liquid;

a propulsion system for propelling the pool cleaner along a submerged surface within the pool; and a controller that is configured to determine a position of the pool cleaner on a stairway of the pool, and to control the propulsion system to stop ascending the stairway when the pool cleaner is determined to have ascended to a highest permissible stair of the stairway.

2. The pool cleaner of claim 1, further comprising a tilt sensor, wherein the controller is configured to detect ascending or descending a stair of the stairway in accordance with a sensed tilt of the pool cleaner.

3. The pool cleaner of claim 2, wherein the controller is configured to detect ascending the stair by detecting, when the pool cleaner is moving with a leading end facing a direction of motion of the pool cleaner, upward tilting of the leading end followed by leveling of the pool cleaner.

4. The pool cleaner of claim 2, wherein the controller is configured to detect descending the stair by detecting, when the pool cleaner is moving with a leading end facing a direction of motion of the pool cleaner, downward tilting of the leading end followed by leveling of the pool cleaner.

5. The pool cleaner of claim 2, wherein the controller is configured to increment a stair count when ascending the stair is detected, and to decrement the stair count when descending the stair is detected.

6. The pool cleaner of claim 5, wherein the controller is configured to compare the stair count with a stair count corresponding to the highest permissible stair.

7. The pool cleaner of claim 1, further comprising a depth sensor, wherein the controller is configured to detect ascending or descending a stair of the stairway in accordance with a depth of the pool cleaner below a waterline of the liquid in the pool.

8. The pool cleaner of claim 7, wherein the controller is configured to compare a sensed depth of the pool cleaner with a depth corresponding to the highest permissible stair.

9. The pool cleaner of claim 1, wherein the controller is configured to reverse a direction of motion of the pool cleaner when the pool cleaner is determined to have ascended to the highest permissible stair.

10. The pool cleaner of claim 9, wherein the controller is configured to reverse the direction of motion of the pool cleaner only if a cleaning program has not been completed.

11. The pool cleaner of claim 10, wherein completion of the cleaning program is indicated by elapse of a predetermined period of time from beginning of operation of the pool cleaner in the pool.

12. The pool cleaner of claim 1, wherein the controller is configured to stop operation of the pool cleaner when the pool cleaner is determined to have ascended to the highest permissible stair.

13. The pool cleaner of claim 12, wherein the controller is configured to stop the operation of the pool cleaner only if a cleaning program has been completed.

14. The pool cleaner of claim 1, wherein a position of the highest permissible stair is pre-programmed in the controller.

15. The pool cleaner of claim 1, wherein the controller is configured to enable entry of a position of the highest permissible stair via a communications link.

16. The pool cleaner of claim 1, wherein the highest permissible stair is selected such that when the pool cleaner is standing on the highest permissible stair, the outlet of the pool cleaner is at least a minimum depth below a level of the liquid in the pool.

17. The pool cleaner of claim 16, wherein the minimum depth is selected to prevent ejection of the liquid from the pool via the outlet.

18. A method for operation of a pool cleaner on a submerged stairway in a pool, the method comprising:

operating a propulsion system of the pool cleaner to propel the pool cleaner along a submerged surface of the pool, the pool cleaner including a housing, a pump for drawing liquid from the pool into the housing through an inlet and expelling the liquid through an outlet when the pool cleaner is submerged in the pool, and a filter for trapping debris that is in the indrawn liquid;

receiving by a controller from one or a plurality of sensors one or more measured values that are indicative of a position of the pool cleaner on the stairway;

analyzing said one or more measured values by the controller to determine the position of the pool cleaner on the stairway; and operating the propulsion system to stop ascending the stairway when the measured values indicate that the pool cleaner has ascended to a highest permissible stair of the stairway.

19. The method of claim 18, wherein stopping the ascending comprises reversing motion of the pool cleaner or stopping operation of the pool cleaner.

20. The method of claim 18, wherein analyzing said one or more measured values comprises, when the pool cleaner is moving with a leading end facing a direction of motion of the pool cleaner, determining that the pool cleaner has ascended a stair when the measured values from a tilt sensor of said one or a plurality of sensors indicate upward tilting of the leading end followed by leveling of the pool cleaner, and that the pool cleaner has descended a stair when the measured values from the tilt sensor indicate downward tilting of the leading end followed by leveling of the pool cleaner.

* * * * *